US005147746A

United States Patent [19]

Ohta

[11] Patent Number: 5,147,746

[45] Date of Patent: Sep. 15, 1992

[54] POWDERED DEVELOPER MATERIAL HAVING SPECIFIC PARTICLE DIAMETER DISTRIBUTION

[75] Inventor: Mitsura Ohta, Nagoya, Japan

[73] Assignee: Brother Kogyo Kabushiki Kaisha, Nagoya, Japan

[21] Appl. No.: 601,400

[22] Filed: Oct. 23, 1990

[30] Foreign Application Priority Data

Oct. 23, 1989 [JP] Japan ..... 1-275399
Oct. 26, 1989 [JP] Japan ..... 1-279227

[51] Int. Cl.[5] ..... G03G 9/09
[52] U.S. Cl. ..... 430/106; 430/111
[58] Field of Search ..... 430/105, 106, 111

[56] References Cited

U.S. PATENT DOCUMENTS 4,837,107 6/1989 Axelsson et al. ..... 430/111
4,943,506 7/1990 Dennizu et al. ..... 430/111
4,957,840 9/1990 Sakashita et al. ..... 430/111

*Primary Examiner*—John Goodrow
*Attorney, Agent, or Firm*—Oliff & Berridge

[57] ABSTRACT

Developer toner color-reactable with dye or dye precursor to form a color image, comprising developer material particles having at least one of a particle-diameter distribution in which the maximum particle diameter of the particle-diameter distribution is not greater than the second power of the average particle diameter on volume-basis of the particle-diameter distribution and another particle-diameter distribution in which Npn > Nsn (Npn represents a particle-occupied ratio on particle-number basis in a range of Dp, Nsn represents a particle-occupied ratio on particle-number basis in a range of Ds, Dp and Ds representing particle-diameter ranges satisfying the following inequalities:

$$10^{(\log(M)-0.05)} \leqq Dp \leqq 10^{(\log(M)+0.05}$$

$$10^{(\log(M)-0.01\times N-0.05)} \leqq Ds \leqq 10^{(\log(M)-0.01\times N+0.05)}$$

where N represents an integer from 1 to 30, and M represents the average particle diameter of the particle diameter distribution on volume-basis.

17 Claims, 1 Drawing Sheet

POWDERED DEVELOPER MATERIAL HAVING SPECIFIC PARTICLE DIAMETER DISTRIBUTION

BACKGROUND OF THE INVENTION

This invention relates to developer material, and more particularly to powdered developer material capable of color-reacting with dye or dye precursor.

A developer sheet has been conventionally formed as a specific sheet by dispersing developer material in an aqueous solvent in an ultrafine particle form, adding binder and additives to the dispersed solution and then coating it on paper. An image forming techinique using the developer sheet thus formed is disclosed in Japanese Unexamined Published Patent Applications No. 58-88739, No. 59-30537 and No. 59-137944.

The image forming technique as described above belongs to any type of technique in which two or more components separated from one another are contacted with one another due to a physical force such as pressure, temperature, etc. to react with one another, and then optical characterisitics such as light-absorbing region, light-absorbing intensity, etc. of the components are changed to record an information in accordance with the physical force. For example, there is an image forming technique utilizing a microcapsule sheet comprising a sheet coated with microcapsules having mechanical strength variable in accordance with light incident thereto and encapsulating colorless or slightly colored dye or dye precursor, and a developer sheet coated with developer material color-reactable with the dye or dye precursor encapsulated in the microcapsules. In this technique, when any kind of photosensitive recording medium coated with the microcapsules which has been exposed to light is superposed over the developer sheet under pressure to perform a pressure-developing process, some microcapsules are selectively ruptured due to a selective change in the mechanical strength to issue the colorless or slightly-colored dye or dye precursor from the ruptured microcapsules, and then the issued dye or dye precursor is color-reacted with developer material serving as a dye receptor coated on the developer sheet to form a visible image on the developer sheet.

In this type of technique, a visible image is formed only on a specifically manufactured sheet such as a developer sheet coated with a dye receptor (developer material). However, it has been frequently required in the art to form a visible image not only on the developer sheet, but also on any kind of medium such as a plain paper, post card or the like. In order to satisfy the above requirement, there has been proposed a developer material toner capable of color-reacting with microcapsules coated on a photosensitive and pressure-sensitive recording meidum, which is powdered and then electrostatically coated on any kind of medium. However, it has been difficult to obain an excellent developer material toner which is easily manufactured, has fluidity and sufficient pressure-fixability to any kind of medium such as plain paper, has stable fixing and developing properties for repetitive use, never adheres to a toner carrier and a toner case and has a high stability during storage period (that is, can be stored with no aggregation and no caking).

In view of the above condition, it has been proposed to add the above developer material toner with a softening agent in order to improve the pressure-fixablity to any kind of medium. However, this type of developer material toner has various problems, for example, it is difficult to finely pulverize the developer material, and even if it is pulverized, powdered developer material toners easily adhere to the toner carrier and the toner case to cause aggregation and caking therebetween. On the other hand, it has been proposed to provide the above developer material toner with a rigid resin in order to easily carry out a powdering process and improve chargeability, fluidity and storing capability. However, the developer toner thus obtained has remarkably-degraded pressure-fixability because the regid resin is generally more regid than the medium such as plain paper and thus it is not entagled in fibers consituting the medium even under pressure (that is, it is not fixed on the medium, but merely pressed against the surface of the medium). Accordingly, there has not been hitherto obtained powdered developer material which has excellent pressure-fixability to any kind of medium and sufficient chargeability, fluidity and storing capability.

SUMMARY OF THE INVENTION

In order to overcome the above disadvantage of the conventional powdered developer material, an object of this invention is to provide developer material toner having excellent pressure-fixability to any kind of medium and sufficient chargeability, fluidity and storing capability.

Another object of this invention is to provide developer material toner which are transferred and fixed to any kind of medium in large amount without offset and adherence to a toner carrier and a toner case.

In order to attain the above objects, developer toner according to this invention is color-reactable with dye or dye precursor to form a color image, and comprises developer material particles having at least one of a particle-diameter distribution in which the maximum particle diameter of the particle-diameter distribution is not greater than the second power of the average particle diameter on volume-basis of the particle-diameter distribution and another particle-diameter distribution in which Npn > Nsn (Npn represents a particle-occupied ratio on particle-number basis in a range of Dp, Nsn represents a particle-occupied ratio on particle-number basis in a range of Ds, Dp and Ds representing particle-diameter ranges satisfying the following inequalities:

$$10^{(\log(M)-0.05)} \leqq Dp \leqq 10^{(\log(M)+0.05)}$$

$$10^{(\log(M)-0.01\times N-0.05)} \leqq Ds \leqq 10^{(\log(M)-0.01\times N+0.05)}$$

where N represents an integer from 1 to 30, and M represents the average particle diameter of the particle diameter distribution on volume-basis.

BRIEF DESCRIPTION OF THE DRAWINGS

The FIGURE is a graph showing a particle diameter distribution on particle-number basis in which the abscissa represents particle diameter and the ordinate represents a particle-occupied ratio on particle-number basis.

DETAILED DESCRIPTION OF THE INVENTION

Figure 1:
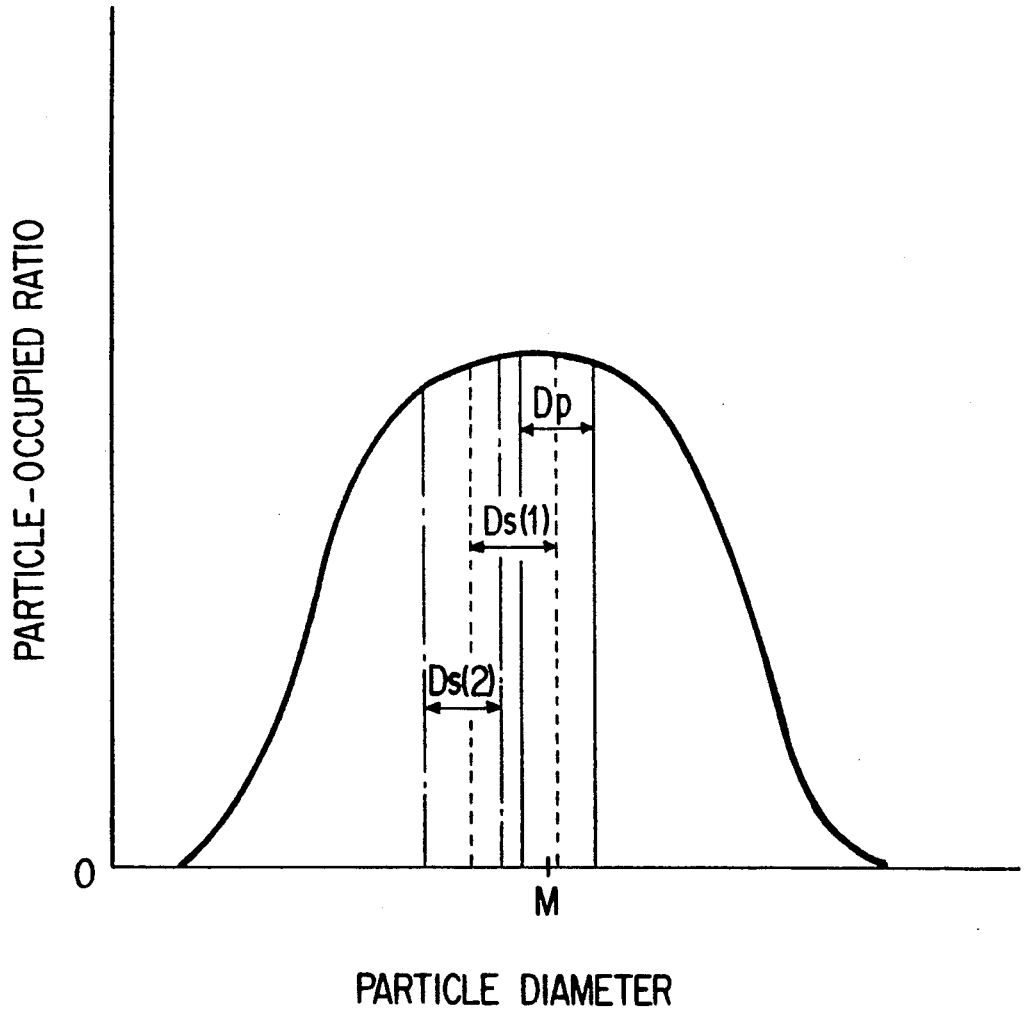

Preferred embodiments of this invention will be described hereunder.

As dye or dye precursor color-reactable with the developer material of this invention may be practically used crystal violet lactone, benzoyl leuco methylene blue, or other materials. The developer material serving as dye receptor preferably includes a natural clay mineral such as acid clay, bentonite, kaolinite, or apatalgide, or organic acid such as tannic acid, gallic acid, or ester of propyl gallic acid, acid polymer such as phenol resin, maleic acid resin, phenol-acetylene resin, or a condensation compound of carboxilic acid having at least one hydroxy group and formaldehyde, or metal salt of carboxilic acid such as zinc salicylate, tin salicylate, zinc 2-hydroxynaphthoate, zinc 3-5-di(tert-butyl)-salicylate, or zinc 3, 5-α-methylbenzyl salicylate, or metal salt of phenol resin compounds obtained by denaturing phenol resin compounds with metal such as zinc, nickel or the like, or a mixture of the above materials.

In a case where the developer material comprising the above material is powdered and electrostatically coated on any kind of medium, fixability and chargeability inheret to the material disturb the powdered developer material to be transferred to the medium. Accordingly, it is required to improve the fixability and chargeability of the developer material. In order to improve fixability and adhesiveness of the developer material toner to any kind of medium, a fixing promoting agent such as wax or adhesive may be mixed to the above material.

As the adhesive may be preferably used ethylene/-viny acetate copolymer, polyviny ether, viny chloride/-viny acetate copolymer, polyvinyl chloride, polyacrylic ester, ethylene/ethyl acrylate copolymer, polyvinyl acetate, or polyvinylbutyral. Further, as the wax may be preferably used carnauba wax, candellila wax, rice wax, lanolin wax, jojoba wax, Japan wax, beeswax, paraffin wax, microcrystalline wax, montan wax, halogenated paraffin wax, castor wax, slack wax, sasol wax, amide wax or ozokerite, or polyolefines such as polyethylene or polypropylene. These adhesives and waxes may be used alone or in combination to the extent that a property inherent to the developer material is not lost.

In order to improve the chargeablity of the developer material toner, a charge-control agent such as nigrosine dye, a metal-containing dye, or quaternary ammonium salt may be preferably mixed with the developer material. Further, in order to maintain the fluidity and lubricity of the surface of the developer material toner, aliphatic hydrocarbon, or higher aliphatic alcohol may be preferably mixed to the developer material.

These mixed materials are premixed and knealed, and then pulverized by a pulverizer, to thereby form particles of the developer material toner. In order to prevent electrostatic aggregation and adhesive aggregation, the surface of the developer material toner may be coated by a spray drying method, a suspension polymerization method, or emulsion polymerization method.

In this invention, the developer material is pulverized and classified so as to obtain only two groups of particles having two types of particle-diameter distributions respectively, and the developer material particles thus obtained are used as the developer material toner. Those developer material particles which belong to the above groups have more sufficient fixability to any kind of medium and higher chargeability and fluidity, and thus can be used as an excellent developer toner. One of the groups is a first group containing developer material particles having a particle-diameter distribution in which the maximum particle diameter of the group is not larger than (or equal to) the second power of the average particle diameter on volume-basis, and the other is a second group containing developer material particles having a particle-diameter distribution in which a particle-occupied ratio on particle-number basis in a range of Dp is higher than that in a range Ds. Here, Dp and Ds represents the following inequalities.

$$10^{(\log(M)-0.05)} \leqq Dp \leqq 10^{(\log(M)+0.05)}$$

$$10^{(\log(M)-0.01XN-0.05)} \leqq Ds \leqq 10^{(\log(M)-0.01XN+0.05)}$$

(N: an integer from 1 to 30, and M represents average particle diameter defined on volume-basis)

The first group of the particles and a manufacturing process thereof will be first described.

At least one of two types of pulverizers are used in a manufacturing process for manufacturing the particles of the first group, one being of an air flow type and the other being of a mechanical type. As the air flow type of pulverizer is well known a collision-plate type of pulverizer (produced by NIPPON PNEUMATIC MFG. CO., LTD) which comprises a pulverizing unit for pulverizing the developer material and a classifying unit for classifying the pulverized developer material. If the air flow type of pulverizer is used to powder the developer material, enormous particles of the pulverized developer material (for example, particles having a diameter above the second power of an average particle diameter defined on volume-basis) are cut off by the classfying unit. On the other hand, if the mechanical type of pulverizer is used to powder the developer material, a diameter-distribution of the powdered developer material is remarkabl broader and thus a large amount of enormous particles having a diameter above the second power of the average particle diameter defined on the volume-basis exist in the powdered developer material. Therefore, in this case, a classifier is further used to cut off the enormous particles.

The particles of the developer material obtained through the above pulverizing and classifying processes are filled in a toner case, and then the toner case is inserted to an image forming apparatus. The powdered developer material, that is, the developer material toners are tribo-electrically charged through friction and contact between the developer material toners or between the developer material toner and a toner carrier such as a carry roller, and then electrically transferred from the toner carrier to any kind of toner supporting medium (for example, a plain paper), so that the toner supporting medium is practically used as image forming medium. The medium coated with the developer material toner is superposed over a pressure-sensitive recording medium coated with microcapsules encapsulating dye precursor therein under pressure to thereby perform both operations for rupturing the microcapsules to issue the dye precursor encapsulated in the ruptured microcapsules and color the dye precursor through a color reaction between the dye precursor and the developer material, and for pressure-fixing the developer material toner to the medium.

If the developer material toner including the enormous particles is electrostatically coated on the medium such as a plain paper to form a toner layer on the medium, the toner layer is unevenly formed on the medium and thus has a rough surface. When the medium coated with the toner layer having the rough surface is pressured by pressure rollers to perform a pressure development, a pressure force is concentrically applied to those portions of the toner layer where the enormous particles exist, and thus other small particles surrouding the portions are liable to attach to the pressure-sensitive recording meidum or exfoliated from the toner supporting medium. Therefore, pinhole portions where the developer material toner is not fixed on the toner supporting medium such as plain pape occur on the toner supporting medium. This phenomenon frequently occurs when the developer material toner has enoumous particles having a larger diameter than the second power of the average particle diameter defined on volum-basis. However, as described above, the enormous particles are removed from the first group of the developer material particles, and therefore the above phenomenon never occurs. Further, it is verified from the following experiment that the developer material particles of the first group have excellent electrostatic transfer.

EXPERIMENT 1

A mixture of 100 parts (by weight) of p-phenyl phenol, 40 parts of zinc 3, 5-di-tert-butylsalicylate, 20 parts of paraffin wax, 10 parts of microcystlline wax and 2 parts of charge control agent are melted and knealed at 100° C., and then cooled and solidified at room temperature to form a lump of resin mixture. The lump of resin mixture is finely pulverized by a rough pulverizer and finely pulverized by an air flow type of jet mill. The pulverized mixture has particles having various diameters from several micron to several hundreds micron, and thus is classified by an air flow type of classifier to obtain developer material toner of particles having diameters from 5 to 20 microns and having the particle-diameter distribution as described above.

The developer material toner thus obtained are filled in an electrostatical coating/developing device, and electrostatically coated on plain paper. Thereafter, the plain paper coated with the developre material toner is superposed over a photosensitive and pressure-sensitive recoridng medium under pressure by pressure rollers to perform a color reaction between the dye precursor and the developer material toner and to fix both of the colored dye precursor and developer material toner on the plain paper. The colored dye precursor and the developer material toner are strongly fixed on the plain paper through a heat-fixing unit to form a visible image on the plain paper.

The second group of the particles and a manufacturing process thereof will be next described hereunder.

In the following description, M represents an average particle diameter defined on volume-basis; Dp, a range of $10^{(log(M)-0.05)}$ to $10^{(log(M)+0.05)}$; Ds(N), a range of $10^{(log(M)-0.01XN-0.05)}$ to $10^{(log(M)-0.01XN+0.05)}$ where N is an integer of 1 to 30; Npv and Nsv, particle-occupied ratios of the respective ranges Dp and Ds in a particle-diameter distribution on the volume-basis; and Npn and Nsn, particle-occupied ratios of the respective ranges Dp and Ds in a particle-diameter distribution on the particle-number basis. As is apparent from the above definitions, Ds(N) is represented by $Dp10^{-0.01XN}$ (N: an integer from 1 to 30), and thus Ds(N)<Dp for all integers of N. Dp means a particle-diameter range including the average particle diameter defined on volume-basis, and Ds(N) means another particle-diameter range for N, which is obtained by shifting the range of Dp in a direction where a particle diameter approaches zero. Further, N means the degree of shift of Dp. The relationship between Ds(N) and Dp is shown in FIGURE, representatively in a case of the particle-diameter distribution on particle-number basis for N=1 and 2 (Ds(1) and Ds(2)).

The developer material is pulverized by the collision-plate type of air flow pulverizer. In the developer material which has been pulverized by the air flow pulverizer, even if in the particle-diameter distribution on the volume-basis Npv is larger than Nsv, there is a case where in the particle-diamter distribution on the particle-number basis Npn is smaller than Nsn, as described below.

The particle-diameter distribution on the particle-number basis is increased in proportion to the third power of rate of that on the volume basis because the number of particles is estimated by one dimension (for example, μm) and the volume of the particles is estimated by three dimension (for example, $(\mu m)^3$). Accordingly, in order to convert a particle diameter defined on the volum basis into that defined on the particle-number, the following equation may be adopted where Nn and Nv represent particle-occupied ratios on particle-number basis and on volume-basis, respectively, n represents the number of ranges into which a particle-diameter distribution is sectioned with respect to particle diameter, and R represents a particle diameter defined on volume-basis.

$$Nn(\%) = \frac{Nv \times R^{-3}}{\sum_{1}^{n} (Nv \times R^{-3})} \times 100$$

The particle-diameter distribution on particle-number basis which is obtained by the above equation shows an increase in particle-occupied ratio on particle-number basis (that is, Nn) in a particle diameter range below the average particle diameter defined on volume basis (that is M), and also shows a decrease in particle-occupied ratio on particle-number basis (Nn) in a particle-diameter range above the average particle diameter. Accordingly, even if the particle-occupied ratio on volume-basis in the range of Dp is larger than that in the range of Ds (that is, Npv>Nsv), there is a case where the particle-occupied ratio on particle-number basis in the range of Dp is smaller than that in the range of Ds (that is, Npn<Nsn). If the particle-occupied ratio of particles in the range Ds on at least one of volume-basis and particle-number basis is larger than that of the range Dp, the fluidity of the particles is remarkably degraded, and thus it causes conglutination and caking of the developer material toners.

In the second group, those particles which are within the range Ds and have a smaller particle diameter than particles in the range Dp are removed by the air flow type of classifier to prevent the conglutination and caking of the developer material toners even if the integer (N) of Ds is changed from 1 to 30. That is, the developer material is pulverized and classified so as to satisfy the following conditions for at least all of integers 1 to 3 of Ds: Npv>Nsv and Npn>Nsn.

Here, the particle-diameter distribution on particle-number represents a relationship between a particle diameter and a ratio of the number of particles having the particle diameter to the total number of all particles, and the particle-diameter distribution on volume-basis represents a relationship between a particle diameter and a ratio of the volume occupied by particles having the particle diameter to the whole volume occupied by all particles. The ratio in the number corresponds to the particle-occupied ratio on particle-number basis (Npn or Nsn), and the ratio in the volume corresponds to the particle-occupied ratio on volume-basis (Npv or Nsv). For example, assuming that the total number of all particle is 1000, the number of particles having a particle diameter range of 5 to 6 microns is 100 and the average particle diameter is 10 microns, the particle-occupied ratio on particle-number basis in the particle diameter range of 5 to 6 microns is 100/1000 (0.1 or 10%), while the particle-occupied ratio on volume-basis in the particle diameter range of 5 to 6 microns is $((4\pi/3)\times(5.5)^3\times100)/((4\pi/3)\times(10)^3\times1000)$ (0.016 or 1.6%).

In the developer material toners obtained in the above pulverizing and classifying processes, the average particle diameter obtained on particle-number basis is near to the average particle diameter obtained on the volume basis, and thus the particle-occupied ratio on particle-number basis in the range of Ds is smaller than that in the range of Dp (that is, Npn > Nsn). Therefore, the developer material particles thus obtained have excellent fluidity, and the caking of the particles and the attachment of the particles to a developing unit can be prevented.

The developer material particles thus obtained are accommodated in the toner case and used as developer material toners. The developer material toners are triboelectrically charged through contact and friction between the developer material toners and between the developer material toner and the developer toner carrier. The charged developer material toners are electrostatically transferred to any kind of medium, and the medium coated with the developer material toners is practically used as an image recording medium.

EXPERIMENT 2

A mixture of 100 parts (by weight) of p-t-butyl phenol, 40 parts of zinc 3, 5-di-tert-butylsalicylate, 20 parts of polyethylene wax, 10 parts of microcystalline wax and 2 parts of charge control agent are melted and knealed at 100° C., and then cooled and solidified at room temperature to form a lump of resin mixture. The lump of resin mixture is finely pulverized by a rough pulverizer and finely pulverized by an air flow type of jet mill. The pulverized mixture has particles having various diameters from several micron to several hundreds micron, and thus is classified by an air flow type of classifier to obtain developer material toner of particles having diameters from 5 to 20 microns and having the particle-diameter distribution as described above.

The developer material toner thus obtained are filled in an electrostatical coating/developing device, and electrostatically coated on plain paper. Thereafter, the plain paper coated with the developre material toner is superposed over a photosensitive and pressure-sensitive recoridng medium under pressure by pressure rollers to perform a color reaction between the dye precursor and the developer material toner and to fix both of the colored dye precursor and developer material toner on the plain paper. The colored dye precursor and the developer material toner are strongly fixed on the plain paper through a heat-fixing unit to completely form a visible image on the plain paper with uniformity.

As described above, the developer material toners according to this invention have excellent fixiability to any kind of medium, chargeability, storage capabiliy and fluidity in an electrostatical developing unit to thereby transfer and fix a large amount of developer toners to any kind of medium without conglutination of the developer material toners to the inner wall of the toner case, and can be electrostatically transferred and coated on any kind of medium.

What is claimed is:

1. Developer toner comprising: developer material particles color-reactable with dye or dye precursor to form a color image, the developer material particles having a particle-diameter distribution, a maximum particle-diameter of said particle-diameter distribution being not greater than the second power of an average particle diameter on volume-basis of said particle-diameter distribution.

2. Developer toner as claimed in claim 1, wherein said maximum particle diameter is equal to the second power of said average particle diameter on volume-basis.

3. Developer toner as claimed in claim 1, wherein said particle diameter distribution having the following inequality: Npn > Nsn, where Npn represents a particle-occupied ratio on particle-number basis in a range of Dp, Nsn represents a particle-occupied ratio on particle-number basis in a range of Ds, and Dp and Ds represent particle-diameter ranges satisfying the following inequalities:

$$10^{(\log(M)-0.05)} \leqq Dp \leqq 10^{(\log(M)+0.05)}$$

$$10^{(\log(M)-0.01\times N-0.05)} \leqq Ds \leqq 10^{(\log(M)-0.01\times N+0.05)}$$

where, N represents an integer from 1 to 30, and M represents the average particle diameter of the particle diameter distribution on volume-basis.

4. Developer toner comprising: developer material particles color-reactable with dye or dye precursor to form a color image, the developer material particles having a particle-diameter distribution, said particle-diameter distribution having the following inequality: Npn > Nsn, where Npn represents a particle-occupied ratio on particle-number basis in a range of Dp, Nsn represents a particle-occupied ratio on particle-number basis in a range of Ds, and Dp and Ds represent particle-diameter ranges satisfying the following inequalities:

$$10^{(\log(M)-0.05)} \leqq Dp \leqq 10^{(\log(M)+0.05)}$$

$$10^{(\log(M)-0.01\times N-0.05)} \leqq Ds \leqq 10^{(\log(M)-0.01\times N+0.05)}$$

where, N represents an integer from 1 to 30, and M represents the average particle diameter of the particle diameter distribution on volume-basis.

5. Developer toner as claimed in claim 1, wherein the developer toner includes a metal salt of phenol resin compounds obtained by denaturing phenol resin compounds with metal.

6. Developer toner as claimed in claim 1, wherein the developer toner includes a metal salt of carboxylic acid.

7. Developer toner as claimed in claim 1, wherein the developer toner is mixed with a fixing promoting agent such as a wax or an adhesive.

8. Developer toner as claimed in claim 5, wherein the developer toner is mixed with a fixing promoting agent such as a wax or an adhesive.

9. Developer toner as claimed in claim 6, wherein the developer toner is mixed with a fixing promoting agent such as a wax or an adhesive.

10. Developer toner as claimed in claim 4, wherein the developer toner includes a metal salt of phenol resin compounds obtained by denaturing phenol resin compounds with metal.

11. Developer toner as claimed in claim 10, wherein the developer toner is mixed with a fixing promoting agent such as a wax or an adhesive.

12. Developer toner as claimed in claim 4, wherein the developer toner includes metal salt of carboxylic acid.

13. Developer toner as claimed in claim 12, wherein the developer toner is mixed with a fixing promoting agent such as a wax or an adhesive.

14. Developer toner as claimed in claim 4, wherein the developer toner is mixed with a fixing promoting agent such as a wax or an adhesive.

15. Developer toner comprising: developer material particles color-reactable with dye or dye precursor to form a color image, the developer material particles having a particle-diameter distribution, said particle-diameter distribution having the following inequality: Npn > Nsn, where Npn represents a particle-occupied ratio on particle-number basis in a range of Dp, Nsn represents a particle-occupied ratio on particle-number basis in a range of Ds, and Dp and Ds represent particle-diameter ranges satisfying the following inequalities:

$$10^{(\log(M)-0.05)} \leqq Dp \leqq 10^{(\log(M)+0.05)}$$

$$10^{(\log(M)-0.01\times N-0.05)} \leqq Ds \leqq 10^{(\log(M)-0.01\times N+0.05)}$$

where, N represents an integer from 1 to 30, and M represents the average particle diameter of the particle diameter distribution on volume-basis, and wherein the developer toner includes a metal salt of phenol resin compounds obtained by denaturing phenol resin compounds with metal.

16. Developer toner as claimed in claim 15, wherein the developer toner is mixed with a fixing promoting agent such as a wax or an adhesive.

17. Developer toner as claimed in claim 16, wherein the developer toner further includes a metal salt of carboxylic acid.

* * * * *